US009200793B2

(12) United States Patent
Wang et al.

(10) Patent No.: US 9,200,793 B2
(45) Date of Patent: Dec. 1, 2015

(54) HEAT DISSIPATION DEVICE FOR LAMPS HAVING DIAPHRAGM PUMP

(75) Inventors: Changyao Wang, Guangdong (CN); Greg Tayco, Port Washington, NY (US)

(73) Assignees: DONG GUAN AMC LIGHTING CO., LTD., Dongguan, Guangdong (CN); WAC LIGHTING CO., Port Washington, NY (US)

( * ) Notice: Subject to any disclaimer, the term of this patent is extended or adjusted under 35 U.S.C. 154(b) by 0 days.

(21) Appl. No.: 14/008,742

(22) PCT Filed: Jun. 1, 2012

(86) PCT No.: PCT/CN2012/076401

§ 371 (c)(1),
(2), (4) Date: Oct. 17, 2013

(87) PCT Pub. No.: WO2013/177797

PCT Pub. Date: Dec. 5, 2013

(65) Prior Publication Data

US 2015/0085501 A1 Mar. 26, 2015

(51) Int. Cl.

| | |
|---|---|
| ***F21V 29/63*** | (2015.01) |
| ***F04B 43/04*** | (2006.01) |
| ***F04B 45/047*** | (2006.01) |
| ***F21V 29/02*** | (2006.01) |
| ***F21V 29/00*** | (2015.01) |

(52) U.S. Cl.

CPC ..... *F21V 29/02* (2013.01); *F04B 43/04* (2013.01); *F04B 45/047* (2013.01); *F21V 29/22* (2013.01); *F21V 29/63* (2015.01)

(58) Field of Classification Search

CPC ..... F21V 29/02; F21V 29/40; F21V 29/402; F21V 29/60; F21V 29/61; F21V 29/63; F04B 43/04; F04B 43/043; F04B 45/047

USPC ..... 417/413.1

See application file for complete search history.

(56) References Cited

U.S. PATENT DOCUMENTS

2009/0229258 A1* 9/2009 Zapf et al. ..... 60/295

FOREIGN PATENT DOCUMENTS

WO WO 2008128635 A1 * 10/2008

OTHER PUBLICATIONS

Machine translation of WO 2008/128635 A1, retrieved Jan. 29, 2015.*

* cited by examiner

*Primary Examiner* — Anh Mai
*Assistant Examiner* — Steven Horikoshi
(74) *Attorney, Agent, or Firm* — Jackson IPG PLLC; Demian K. Jackson

(57) ABSTRACT

A heat dissipation device for lamps comprises an AC electromagnet coil, a rotor, a support, a filmcoated sheet and a heat sink, the rotor being assembled together with the support via a rotating shaft, the AC electromagnet coil and the support being assembled together, the filmcoated sheet and the heat sink being connected together to form an airbag, the support being provided thereon with a lifting mechanism that is connected with the filmcoated sheet, the lower surface of the rotor being designed with a lug for intermittently pressing the lifting mechanism during the rotation; and, the lifting mechanism comprises an expansion link, a spring, a spring pressing member and a membrane connector.

3 Claims, 2 Drawing Sheets

HEAT DISSIPATION DEVICE FOR LAMPS HAVING DIAPHRAGM PUMP

TECHNICAL FIELD

The invention relates to the technical field of lamps, particularly to a heat dissipation device for lamps.

BACKGROUND OF THE INVENTION

Heat dissipation devices for lamps in the prior art have high noise, high energy consumption, low rotational speed and unsatisfactory heat dissipation effect during use and short service life. With the continuous development of the society and the constant improvement of people's production level, the requirements on the quality of lamps are higher and higher, and lamps are upgraded continuously. During the upgrade of lamps, a heat dissipation device for lamps with low noise and low energy consumption is urgently expected.

SUMMARY OF THE INVENTION

A technical problem to be solved by the invention is to provide a heat dissipation device for lamps, to overcome defects of high noise, high energy consumption, low rotational speed and unsatisfactory heat dissipation effect during use and short service life of the heat dissipation devices for lamps in the prior art. This heat dissipation device for lamps has advantages of low noise, low energy consumption, no lubrication required and free of oil pollution during use and long service life. A lamp equipped with the heat dissipation device is applicable to high-speed, vacuum, ultra quiet and other special environments.

The following technical solution is employed by the invention to solve the above technical problem, a heat dissipation device for lamps is provided, comprising an AC electromagnet coil, a rotor, a support, a filmcoated sheet and a heat sink. The rotor is assembled together with the support via a rotating shaft. The AC electromagnet coil and the support are assembled together. The filmcoated sheet and the heat sink are connected together to form an airbag. The support is provided thereon with a lifting mechanism that is connected with the filmcoated sheet. The lower surface of the rotor is designed with a lug for intermittently pressing the lifting mechanism during the rotation.

In the above technical solution, the lifting mechanism comprises an expansion link, a spring, a spring pressing member and a membrane connector. The spring pressing member and the membrane connector are disposed at upper and lower ends of the expansion link, respectively. The upper end of the spring sleeved on the expansion link is against the spring pressing member while the lower end thereof is against the support. The membrane connector and the filmcoated sheet are connected together. The expansion link and the support are assembled together in a movable fit way.

Further, the heat sink of the heat dissipation device for lamps is provided thereon with an air intake passage for communicating the airbag with the outside, and an air intake valve for only air intake but not air exhaust is disposed in the air intake passage.

Further, the heat sink of the heat dissipation device for lamps is provided thereon with an air exhaust passage for communicating the airbag with the outside, and an air exhaust valve for only air exhaust but not air intake is disposed in the air exhaust passage.

The invention has the following advantages. 1. As an alternating current passes through the AC electromagnet coil, a magnetic field is generated around the AC electromagnet coil and drives the rotor to rotate, so that the rotor drives the lug to rotate; as the lug intermittently presses the lifting mechanism during the rotation, the lifting mechanism moves up and down to drive the filmcoated sheet connected with the lifting mechanism to stretch and compress; therefore, the airbag formed by the filmcoated sheet and the heat sink connected together is stretched and compressed, and a circulation is implemented; as the lug intermittently presses the lifting mechanism during the rotation, the lifting mechanism cyclically moves up and down, and the filmcoated sheet is driven to cyclically move up and down by the lifting mechanism, so that the airbag is stretched and compressed, thereby realizing cyclic air inhalation and exhalation. The air sucked in the airbag takes heat away, so the invention has low noise, low energy consumption, no lubrication required and free of oil pollution during use and long service life. 2. When the airbag inhales, the air intake valve is opened, so that air enters into the airbag and the heat performs heat exchange in the airbag; when the airbag exhales, the air exhaust valve is opened, so that air is exhausted from the airbag and the heat is emitted into the external environment; and the heat of the heat sink is carried out from the airbag by the intake and exhaust air, so that the purpose of heat dissipation of the heat sink is achieved. 3. The heat dissipation device for lamps utilizes the electromagnetic induction principle to reduce mechanical friction and prolong the service life of moving parts, and a lamp equipped with this heat dissipation device has long service life. 4. Due to low noise, no lubrication required and free of oil pollution during use, the invention accords with the environmental requirements. 5. For Due to low energy consumption during use, the invention accords with the energy saving requirements. 6. A lamp equipped with this heat dissipation device is applicable to high-speed, vacuum, ultra quiet and other special environments.

DETAILED DESCRIPTION OF THE INVENTION

The invention will be further described as below in details with reference to drawings and embodiments, but the implementation scope of the invention is not restricted to those described below.

Figure 1:
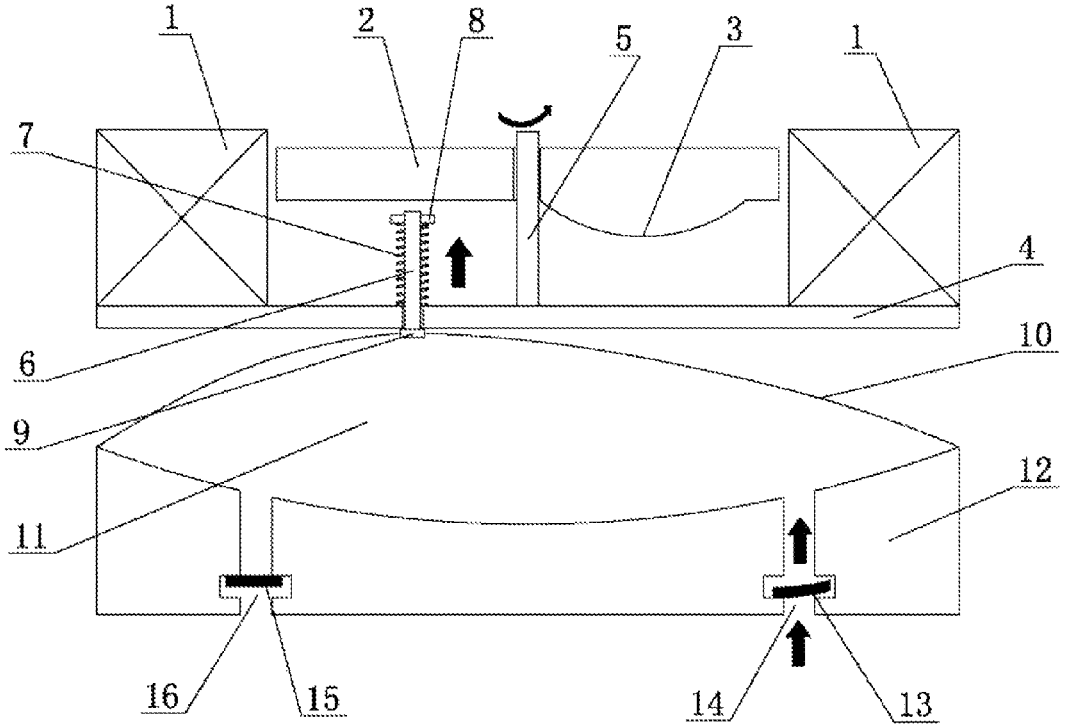
FIG. 1 is a structure diagram of an airbag during air intake in the invention.
Figure 2:
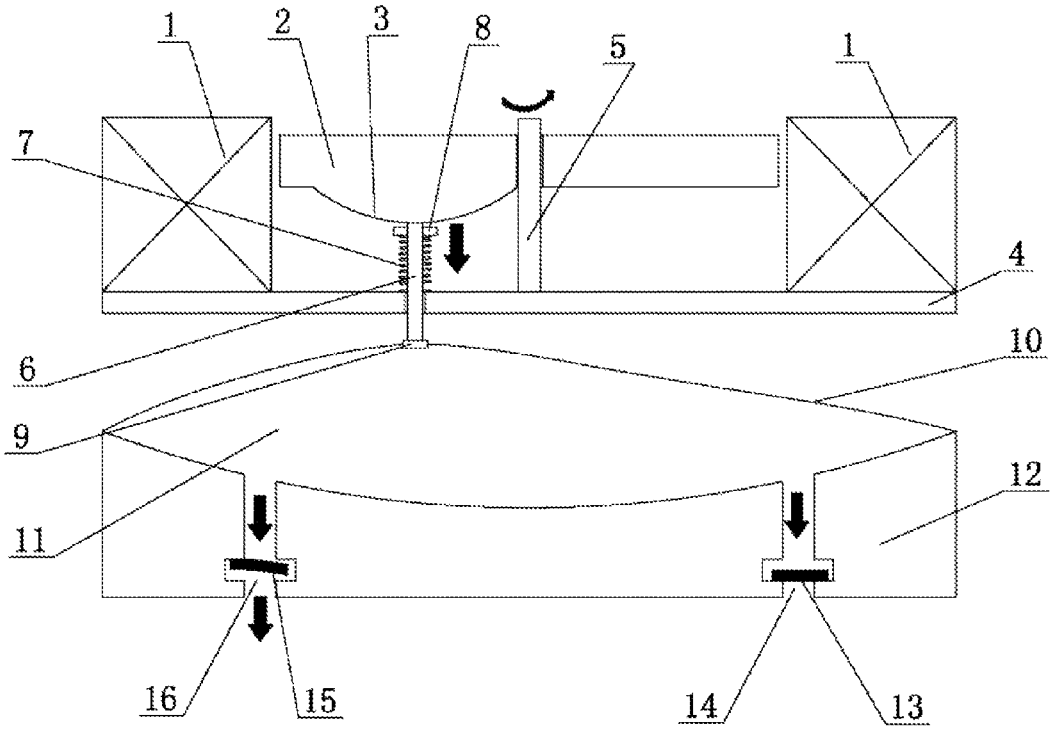
FIG. 2 is a structure diagram of an airbag during air exhaust in the invention.

As shown in FIG. 1 to FIG. 2, the heat dissipation device for lamps in this embodiment comprises an AC electromagnet coil 1, a rotor 2, a support 4, a filmcoated sheet 10 and a heat sink 12. The filmcoated film 10 is made of flexible material. The rotor 2 is assembled together with the support 4 via a rotating shaft 5. The AC electromagnet coil 1 and the support 4 are assembled together. The filmcoated sheet 10 and the heat sink 12 are connected together to form an airbag 11. The support 4 is provided thereon with a lifting mechanism that is connected with the filmcoated sheet 10. The lower surface of the rotor 2 is designed with a lug 3 for intermittently pressing the lifting mechanism during the rotation process. The lug 3 intermittently presses the lifting mechanism during the rotation, so the lifting mechanism cyclically moves up and down. The filmcoated sheet 10 is also driven to cyclically move up and down by the lifting mechanism. The airbag 11 is stretched and compressed to realize cyclic air intake and air exhaust. The air sucked into the airbag 11 takes heat away. The embodiment has low noise, low energy consumption, no lubrication required and free of oil pollution during use and long service life. The lifting mechanism comprises an expansion link 6, a spring 7, a spring pressing member 8 and a membrane connector 9. The spring pressing member 8 and the membrane connector 9 are disposed at upper and lower ends of the expansion link 6, respectively. The upper end of the spring 7 sleeved on the expansion link 6 is against the spring pressing member 8 while the lower end thereof is against the support 4. The membrane connector 9 and the filmcoated sheet 10 are connected together. The expansion link 6 and the support 4 are assembled together in a movable fit way. The heat sink 12 is provided thereon with an air intake passage 14 for communicating the airbag 11 with the outside, and an air intake valve 13 for only air intake but not air exhaust is disposed in the air intake passage 14. The heat sink 12 is also provided thereon with an air exhaust passage 16 for communicating the airbag 11 with the outside, and an air exhaust valve 15 for only air exhaust but not air intake is disposed in the air exhaust passage 16. The operating principle of this embodiment is as follows. When the alternating current passes the AC electromagnet coil 1, a magnetic field is generated around the AC electromagnet coil 1 to drive the rotor 2 to rotate. The rotor 2 drives the lug 3 to rotate, and the lug 3 intermittently presses the lifting mechanism during the rotation, so that the lifting mechanism moves up and down to drive the filmcoated sheet 10 connected with the lifting mechanism to stretch and compress. Therefore, the airbag 11 formed by the filmcoated 10 and the heat sink 12 connected together is stretched and compressed and a circulation is implemented. As shown in FIG. 1, if the rotating shaft 5 rotates according to the direction of the arrow, the lug 3 is away from the lifting mechanism, and the expansion link 6 moves upward under the action of the spring 7 (shown as an arrow). The membrane connector 9 disposed on the expansion link 6 drives the filmcoated sheet 10 to stretch. The airbag 11 inhales air, and the air intake valve 13 is opened, so the air enters into the airbag 11 through the air intake passage 14 (shown as an arrow), and the heat performs heat exchange in the airbag 11. As shown in FIG. 2, if the rotating shaft 5 rotates according to the direction of the arrow, the lug 3 is against the lifting mechanism, and the expansion link 6 moves downward under the action of the lug 3 (shown as an arrow), so the membrane connector 9 disposed on the expansion link 6 drives the filmcoated sheet 10 to move downward (with compression function). The airbag 11 exhales air, and the air exhaust valve 15 is opened, so the air is exhausted from the airbag 11 through the air exhaust passage 16 (shown as an arrow). The heat is emitted into the external environment along with the air. The heat of the heat sink 12 is carried out from the airbag 11 by the intake and exhaust air, so that the purpose of heat dissipation of the heat sink 11 is achieved. The direction is subject to FIG. 1. The upper part of FIG. 1 refers to Up, while the lower part thereof refers to Down.

The embodiment described above is just a preferred embodiment of the present invention. Thus, all equivalent changes or modifications made according to the constructions, characteristics and principles claimed by the patent application should fall into the protection scope of the patent application.

The invention claimed is:

1. A heat dissipation device for lamps, comprising an AC electromagnet coil (1), a rotor (2), a support (4), a sheet of flexible material (10) and a heat sink (12), the rotor (2) being assembled together with the support (4) via a rotating shaft (5), the AC electromagnet coil (1) and the support (4) being assembled together, the sheet of flexible material (10) and the heat sink (12) being connected together to form an airbag (11), wherein the support (4) is provided thereon with a lifting mechanism that is connected with the sheet of flexible material (10), and the lower surface of the rotor (2) is designed with a lug (3) for intermittently pressing the lifting mechanism during the rotation, wherein the lifting mechanism comprises an expansion link (6), a spring (7), a spring pressing member (8) and a membrane connector (9), the spring pressing member (8) and the membrane connector (9) being disposed at upper and lower ends of the expansion link (6), respectively, the upper end of the spring (7) sleeved on the expansion link (6) being against the spring pressing member (8) while the lower end thereof being against the support (4), the membrane connector (9) and the sheet of flexible material (10) being connected together, the expansion link (6) and the support (4) being assembled together in a movable fit way.

2. The heat dissipation device for lamps according to claim 1, wherein the heat sink (12) is provided thereon with an air exhaust passage (16) for communicating the airbag (11) with the outside, and an air exhaust valve (15) for air exhaust only but not air intake is disposed in the air exhaust passage (16).

3. The heat dissipation device for lamps according to claim 1, wherein the heat sink (12) is provided thereon with an air intake passage (14) for communicating the airbag (11) with the outside, and an air intake valve (13) for air intake only but not air exhaust is disposed in the air intake passage (14).

* * * * *